US005782111A

United States Patent [19]

Sights et al.

[11] Patent Number: 5,782,111

[45] Date of Patent: Jul. 21, 1998

[54] MECHANICAL DESIZING AND ABRADING APPARATUS

[75] Inventors: James Barton Sights, Henderson; Lewis Shane Smithhart, Robards; John Alfred Laughlin, Poole; Richard Allen Gaines, Robards, all of Ky.

[73] Assignee: Sights Denim Systems Inc. Henderson, Ky.

[21] Appl. No.: 674,344

[22] Filed: Jul. 2, 1996

[51] Int. Cl.[6] ..... D06F 21/04; D06F 37/06

[52] U.S. Cl. ..... 68/142

[58] Field of Search ..... 68/142, 60; 69/30

[56] References Cited

U.S. PATENT DOCUMENTS

| | | | |
|---|---|---|---|
| 50,638 | 10/1865 | Smith | 68/142 |
| 820,349 | 5/1906 | Church | 68/142 |
| 2,044,946 | 6/1936 | Kannel | 69/30 |

*Primary Examiner*—Philip R. Coe
*Attorney, Agent, or Firm*—John Lezdey

[57] ABSTRACT

A rotary drum washer having an abrasive structure therein for treating fabrics or garments in a wash medium and a method of abrading fabrics or garments employing the abrasive structure to produce a controlled abrasion of the fabrics or garments are disclosed. The abrasive structure is formed with a multiplicity of protrusions and abrading tumbling ribs.

11 Claims, 1 Drawing Sheet

FIG. 1
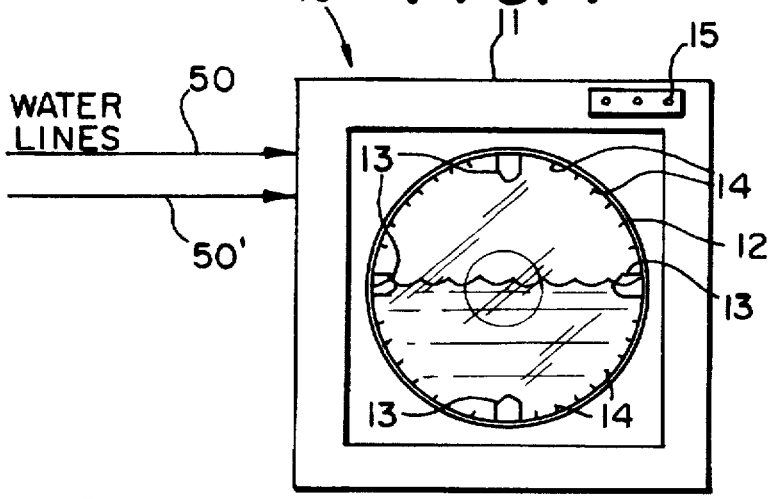
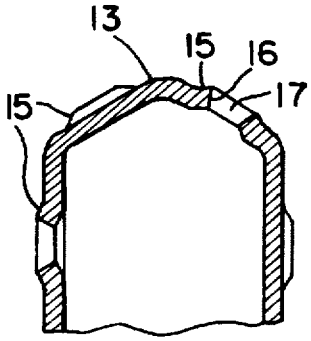
FIG. 2A
FIG. 2
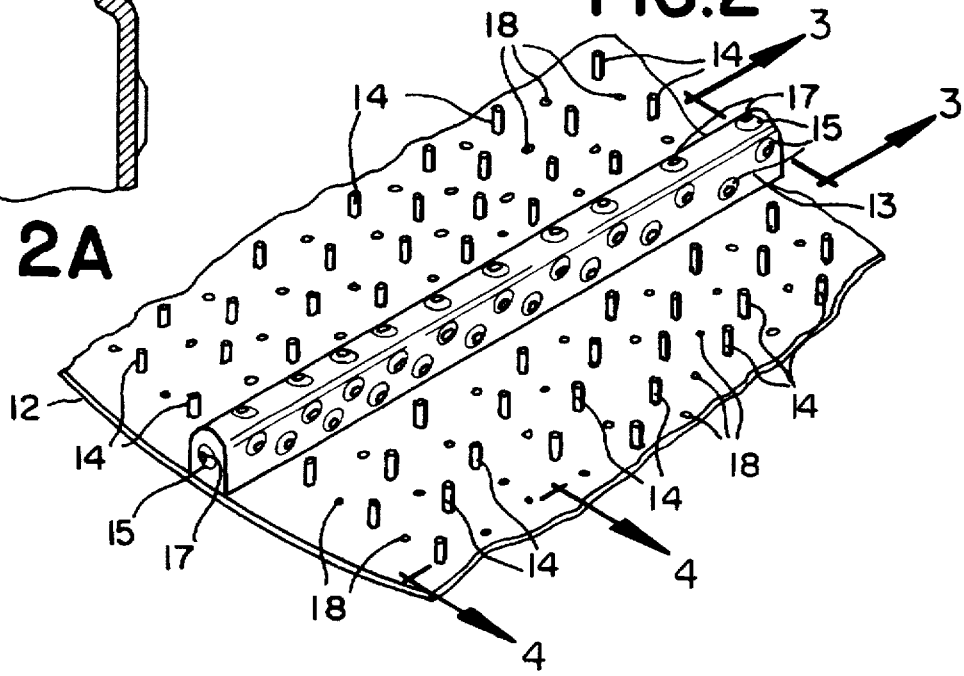
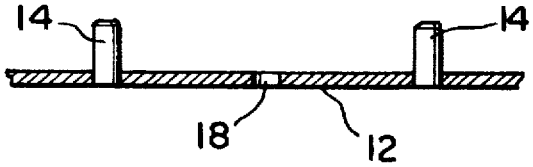
FIG. 3

MECHANICAL DESIZING AND ABRADING APPARATUS

FIELD OF THE INVENTION

This invention relates to rotary drum washer having abrasive structures therein for abrading and desizing fabrics or garments. More particularly, this invention relates to abrasive structures to be used in a "stone washing" process and to methods for treating fabrics and garments to achieve a controlled abrasion of those fabrics and garments.

DESCRIPTION OF THE PRIOR ART

Stone washing is the term used to describe methods for imparting a soft look to new garments particularly those made of denim. Generally, prior art methods employed for stone washing involve the use of pumice stones. These large stones (2 inches or larger) circulate with the garments in suitable equipment such as a commercial rotary-drum washer, and/or washer-extractor, abrading and softening the garments. However, there are major disadvantages with this method including damage to the equipment along with causing tears and holes in the garments. The rotation or agitation of the drum also causes the large stones to strike the inside of the drum resulting in damage thereto. These collisions break the pumice stones and form sharp edges on the resulting smaller particles which exacerbates the damage to the garments and equipment. Another disadvantage of the pumice stone method is that after each abrading treatment, the stones and stone fragments must be laboriously removed from the drum as the fabrics and garments are prepared for rinsing and drying. This is particularly of concern in commercial operations since this removal is time consuming and a labor intensive operation.

Another prior art method involves the use of a washer drum which has been roughen by abrasive agents such as pumice or other volcanic rock. Fabrics and garments are placed in the drum and are abraded by the rough surface of the drum. The disadvantages of this method include the time and cost of repeated resurfacings of the drum and the considerable processing time required to obtain the desired results on the garments.

In summary the major disadvantages of the above described methods include the unintentional abrasion of the inside wall of the washer cylinder or drum, the costs and time involved in filtering out the pumice from the wash liquid, the necessity to have one or more subsequent rinse steps to remove pumice from the garments after the abrasion step. Additionally there is constant attrition and loss of abrasive material, which requires that substantial quantities of abrasive material be replaced. Furthermore, obtaining uniform abrasion has not proved successful with existing methods.

SUMMARY OF THE INVENTION

It is now been found that a suitable abrasive structure in which the aforementioned disadvantages or drawbacks are eliminated or substantially reduced and in which the range of usefulness of the abrasive structure is greatly extended. According to the present invention there is provided in a washer having a rotatable barrel, an abrasive structure mounted for rotation with the barrel comprising:

(1) an apertured structural form having substantial structural exterior metal surface area;

(2) a multiplicity of solid protrusions affixed to said metal surface area; and (3) a plurality of apertured tumbling ribs, said ribs having embossments which provide an abrasive surface running the length of the barrel, whereby the protrusions and ribs abrade and desize the fabric or garments during rotation.

Advantageously, the protrusions are throughout the entire interior of the barrel.

The abrasive structure, namely, the tumbling ribs and panels with the protrusions can be used in commercial washers either as initial construction or as a modification to existing machines to produce a stone washing effect on fabrics and garments. Preferably the abrasive structure is provided with a plurality of openings that range from 0.2 to about 1 cm and more preferably about 0.3 to about 0.5 cm. The openings should be such that buttons or snaps which are found on the garments do not get caught and cause damage to that garment. The shape of the openings is not critical. Openings which are round or elliptical are easily produced by a simple punching operation.

The invention further provides a method which comprises introducing into a rotary drum washer equipped with at least one abrasive structure of the invention, water and optionally fabric treatment compositions to uniformly abrade and desize the fabrics and garments. The washer is rotated clockwise and then counterclockwise. These fabrics and garments are then rinsed with an appropriate fluid which is subsequently drained from the drum and then the workpieces are removed from the washer. The method exposes the fabrics or garments to a considerably greater and more uniform surface area of abrasive structure providing even and more rapid abrasion with little or no damage to the fabrics.

It is a primary object of this invention to provide an abrasive structure having a uniform abrasive surface which will not damage or excessively wear fabrics and garments being subject to a stone washing method which will not deteriorate during use, and which will provide the appearance of uniformly stone washed garments having a consistent nap and low level amount of textile wear.

It is also an object of this invention to provide a method for use in the abrading of fabrics and garments which is more efficient, has a more uniform surface area and yields a fabric or garment with little or no damage to the workpiece.

It is another object of this invention to provide a novel mechanical means for desizing and abrading fabric and garments in a single operation.

It is a further object of this invention to provide processes for stone washing garments, particularly denim garments, as well as, fabrics in general, which are less wearing on the commercial washing equipment which employ reduced amounts of abrasive material such that energy requirements are less and which provide satisfactory and uniform wear characteristics on the garments which are treated.

In is understood that the term "washer" as used herein refers not only to washers but also washer-extractors which are normally used in the garment industry.

BRIEF DESCRIPTION OF THE DRAWINGS

FIG. 1 is a front elevational view of a washer illustrating one form of abrasive panels and tumbling ribs of the invention.

FIG. 2 is a sectional perspective view of a panel with the protrusions and tumbling rib of the invention.

FIG. 2A is a side sectional view of a panel showing an opening and the protrusions.

FIG. 3 is a sectional view of a tumbling rib taken along line 3—3 FIG. 2.

DETAILED DESCRIPTION OF THE PREFERRED EMBODIMENTS

In accordance with the present invention the above mentioned and other objects are achieved by employing structures for abrading fabrics as in stone washing processes which comprise a substantial structural interior metal surface area having a multiplicity of protrusions in the form of studs and tumbling ribs having an embossed surface.

In a preferred embodiment, the abrasive structure, particularly when used in a rotary drum washer, is a rectilinear panel having a plurality of openings or holes. The holes may be punched or drilled before or after the protrusions, e.g. studs are applied. The openings or holes should be designed to permit water drainage, as well as, prevent buttons or snaps which are found on the garments from falling through or getting caught and causing damage to that garment. The openings range from about 0.2 cm to about 1 cm and preferably about 0.3 cm to about 0.5 cm. The shape of the openings is not critical. Preferably the openings are round or elliptical in shape for ease in manufacture. The panels can also be formed separate from the rotary drum or integral with it. The protrusions can be in the form of studs, rivets, bolts and the like having a height of about 0.7 to 2.5 cm, preferably 1.2 cm and a diameter of about 0.7 to 1.7 cm. They may be of any geometric configuration.

The apertured panels are suitably made from corrosion resistant sheet metal, e.g., 12 to 10 gage material stainless steel. The thickness is not critical and only limited by weight considerations regarding the operation of the rotary drum washer.

Referring to FIG. 1 a rotary drum washer 10 having a housing 11, water inlet lines 50, 50', control board 15 and an access door 12 is provided with the apertured panels 12 of this invention with protrusions 14 and tumbling ribs 13 along the drum interior. In the preferred embodiment of the present invention a commercial washer such as a Brim Unloading Washer Mfg. by Brim Laundry Machinery, Dallas, Tex. can be adapted with the protrusions 14 and ribs 13 of the invention. However, any vessel capable of retaining and agitating the fabrics or garments can be modified including conventional household washing machines. The panels 12 of the invention with the protrusions 14 and ribs 13 are substantially rectilinear and can be used as a single panel along the interior. The side walls of the washer can merely contain protrusions. The length of the ribs 13 are not essential but preferably run the length of the drum. As mentioned hereinbefore the weight of the panels 12 are not critical so long as they do not interfere with the operation of the washer. Also the height or protrusion of the ribs 13 into the drum is not critical but should be about 3 cm to about 8 cm. The ribs 13 can be installed during the initial construction of the washer or the tumbling ribs of conventional washer can be modified by attaching panels of an apertured abrasive or embossed structure to the existing tumbling ribs with suitable removable fasteners or by welding. Similarly, the interior of the washer can have the apertured abrasive panels with protrusions 14 installed.

FIG. 2 and 2A illustrate the panel 12 with holes or openings 18 arranged in rows to form an apertured panel containing a tumbling rib 13 that can be attached to the interior of the rotary drum. The holes or openings 18 serve several functions; they reduce the weight of the tumbling rib 13 or panel 12 and permit process liquids to drain through to the outside. FIGS. 2 and 3 show the holes or openings 18 in the panel 12.

FIG. 2A shows the ribs 13 with openings 17 in the raised embossments 15 of the ribs 13 in elliptical form. These openings range in size from about 0.2 cm to about 1 cm and more preferably about 0.3 cm to 0.5 cm. This size, range and shape prevents the buttons or snaps which are attached to the garments form getting caught and cause damage to that garment. However, not all of the embossments need to be apertured.

The degree of abrasion can be controlled by the size and diameter of the protrusions as well as their geometric shape. Rounded ends are less abrasive than shape cornered ends.

For optimum abrading efficiency, two parameters must be considered:

(1) the ratio process liquid weight to the fabric or garment load weight; and (2) the rotational speed of the drum.

The proper amount of process liquid required to obtain uniform abrasion is important. An insufficient amount of the liquid in the drum will cause the garments to become tangled with each other and limit only certain areas of the garment to the abrasion of the tumbling rib, thereby producing an uneven finish to the fabric and garment. While an excess of process liquid will act as a lubricant and not allow the garment to be picked up by the tumbling ribs which reduces the scraping action required to impart the degree of abrading desired to produce the stone washing effect. The proper ratio of process liquid weight to load weight of the fabrics or garment is about 4:1 to about 15:1.

Another critical parameter in improving the abrading efficiency of a commercial washer is the proper rotational speed of the drum. However, commercial washers are manufactured in different diameter dimensions and load capacities, a specific rotational speed range to yield the desired degree of abrasion cannot be established. For efficient abrading the proper rotational speed can be determined by observing the movement of the garments within the drum. For example, in a drum having four tumbling ribs such as shown in FIG. 1, fabrics and garments are introduced along with a sufficient amount of process liquid. The proper rotational speed permits the outer garments to an abrading action during the left portion of the clockwise rotational movement, i.e., from 6 o'clock to 11 o'clock and the inner garments receive some abrading action when they come in contact with the outer garments in the lift and fall modes. Inner garments do not contact the tumbling ribs. As the outer garments fall to the bottom of the drum they become the inner garments and fall on the tumbling rib abrading the contacting garment. The tumbling ribs hold the garments in position to the fall point and this cycle continues for the duration of the process time giving a uniform finish to all the treated garments. Preferably, the machine also can be operated to rotate in a counter-clockwise fashion to even the wear on the tumbling ribs.

Thereafter, the wash water is drained, one or more rinse cycles are conducted and the abraded fabric or garment is removed and dried.

The process liquid may be water or an aqueous solution of soap, detergents or desizing agent or mixture thereof.

EXAMPLE 1

A load of denim garments weighing 100 pounds is introduced into the tumbler compartment of a commercial washing machine (Brim) modified with apertured structural panels having a multiplicity of protruding studs and the tumbling ribs according to the present invention. Water at 140°–150° F. is added together with 3 weight percent of a desizing agent and 3 weight percent of a detergent. The machine is agitated for about 10 to about 90 minutes by rotation clockwise for a period and then counterclockwise until the desired degree of stone washing is obtained. Sodium hypochlorite bleaching agent is introduced into the tumbler. The aqueous liquid is then drained and the garments are rinsed with cold water.

The abraded denim garments are then rinsed with a 2% by weight of a textile softener. The softener solution is drained and the garments are removed from the machine and dried. In the example a cold water rinse is sufficient, i.e., tap water temperature. In some circumstances warm water may be used as is shown in the laundry process.

The finished denim garments have a uniform soft worn appearance.

While the foregoing is illustrative of the preferred embodiments of the invention, it is clear that other modifications may be had within the scope of the invention.

What is claimed:

1. In a washer having a controlled rotary barrel for clockwise and counterclockwise rotation at a selected speed, the improvement comprising an abrasive structure within said barrel mounted for rotation with said barrel and said barrel comprising:

(1) an apertured structural form having a multiplicity of solid studs ; and (2) a plurality of apertured tumbling ribs having raised embossments, said ribs running the length of said barrel; and said washer having means to infect an amount of water into said barrel so as to create a water to fabric ratio by weight within said barrel of about 4:1 to 15:1.

2. The washer of claim 1 wherein said studs have a height of about 0.7 to 2.5 cm.

3. The washer of claim 2 wherein said studs have a diameter, said diameter being about 0.7 to 1.7 cm.

4. The washer of claim 1 wherein said abrasive structure and said barrel are integral.

5. The washer of claim 1 wherein said apertures have a diameter, said diameter being about 0.2 to 1.7 cm diameter.

6. The washer of claim 1 wherein said tumbling ribs are removably affixed.

7. The washer of claim 1 wherein said abrasive structure is made entirely of stainless steel.

8. The abrasive structure of claim 1 wherein the structural form is a rectilinear panel.

9. The abrasive structure of claim 8 wherein said rectilinear panel contains a plurality of apertures selected from elliptical, oblong or circular shapes.

10. The abrasive structure of claim 9 wherein said plurality of apertures are circular in shape.

11. A washer for fabric having a controlled rotary barrel for clockwise and counterclockwise rotation, comprising a barrel having an abrasive structure within said barrel fixedly mounted for rotation with said barrel and further having:

(1) an apertured structural form having a multiplicity of solid studs, said studs providing a means for abrading said fabric;

(2) a plurality of apertured tumbling ribs having raised embossments, said ribs running the length of said barrel, and providing means for tumbling and abrading said fabric;

(3) said washer having means to rotate said rotary barrel, said means being adjustable so as to rotate said barrel at a rotational speed to optimally abrade and desize said fabric; and a means to inject an amount of water into said rotary barrel, said means adjustable to create a water to fabric ratio by weight within said barrel of about 4:1 to 15:1 to optimally abrade said fabric.

* * * * *